US007117806B2

(12) United States Patent
Kamio et al.

(10) Patent No.: US 7,117,806 B2
(45) Date of Patent: Oct. 10, 2006

(54) PERSONAL WATERCRAFT

(75) Inventors: Kunihiko Kamio, Kobe (JP); Takeru Oshima, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/728,575

(22) Filed: Dec. 5, 2003

(65) Prior Publication Data

US 2004/0134401 A1 Jul. 15, 2004

(30) Foreign Application Priority Data

Dec. 6, 2002 (JP) ..... 2002-354603

(51) Int. Cl.
*B63B 13/00* (2006.01)
*B63B 11/00* (2006.01)

(52) U.S. Cl. ..... 114/55.51; 114/55.56; 114/183 R

(58) Field of Classification Search ..... 114/55.5, 114/55.51, 55.53, 55.56, 55.57, 55.58, 183 R, 114/197
See application file for complete search history.

(56) References Cited

U.S. PATENT DOCUMENTS 5,036,789 A * 8/1991 Kelly et al. ..... 114/357
5,240,443 A * 8/1993 Futaki ..... 440/38
5,376,028 A * 12/1994 Koyanagi ..... 440/41
5,699,750 A * 12/1997 Schneider ..... 114/357
5,921,198 A * 7/1999 Yoshida ..... 114/357
6,077,135 A * 6/2000 Ito ..... 440/83
6,471,557 B1 * 10/2002 Hattori ..... 440/88 R
6,530,336 B1 * 3/2003 Ibata et al. ..... 114/55.5
6,761,122 B1 * 7/2004 Nakagawa et al. ..... 114/55.56

FOREIGN PATENT DOCUMENTS

JP 05085462 A * 4/1993
JP 08067296 A * 3/1996
JP 09086481 A * 3/1997
JP 10203469 A * 8/1998
JP 2000185689 A * 7/2000

* cited by examiner

*Primary Examiner*—Ajay Vasudeva
(74) *Attorney, Agent, or Firm*—Alleman Hall McCoy Russell & Tuttle LLP

(57) ABSTRACT

A body structure of a water-jet propulsion personal watercraft, comprises a body having an inner space defined by a hull and a deck, an engine mounted within the inner space of the body, a water jet pump placed behind the engine and configured to be driven by the engine, and a bulkhead placed behind the engine and configured to separate the inner space into an engine room on a front side within which the engine is contained, and a closed rear space on a rear side, wherein a first drain hole is provided in the closed rear space of the body so as to communicate with an outside of the watercraft.

16 Claims, 6 Drawing Sheets

PERSONAL WATERCRAFT

BACKGROUND OF THE INVENTION

1. Field of the Invention

The present invention relates to a body structure of a water-jet propulsion personal watercraft, and more particularly to a body structure of a personal watercraft having a closed rear space in a rear portion of the body.

2. Description of the Related Art

In recent years, water-jet propulsion personal watercraft have been widely used in leisure, sport, rescue activities, and the like. A typical personal watercraft includes an engine mounted in a space within the watercraft that is surrounded by a hull and a deck. The engine is configured to drive a water jet pump, which pressurizes and accelerates water sucked from a water intake generally provided on a bottom surface of the hull and ejects it rearward from an outlet port. As the resulting reaction, the personal watercraft is propelled forward.

The engine is mounted within an engine room located substantially at the center of the body of the personal watercraft. The water jet pump is equipped in a pump room in a rear portion of the body and located behind the engine room. The water jet pump is covered by a pump casing.

For the purpose of improved rigidity of the body, in some personal watercraft, a bulkhead is provided on a rear side of the engine room. In order to gain a buoyant force acting on the body, a closed space defined by the hull, the deck, and the bulkhead is formed behind the bulkhead, and contains a foam structure.

Within this closed rear space, various pipes, such as an exhaust pipe configured to discharge an exhaust gas from the engine outside the watercraft, a cooling water drawing pipe configured to draw water drawn from an inside of the water jet pump to the engine for use as cooling water to cool engine components, and a drain pipe configured to discharge water flowing into the engine room outside the watercraft, are provided, and these pipes form an intricate configuration.

Since the closed rear space has an intricate shape and contains various pipes as described above, a foam structure made of urethane that tends to be cured soon after being injected into the rear space. In this manner, a large amount of foam structure may be formed within the rear space with little effort.

However, the rear space is not completely sealed, and water sometimes flows into the rear space. In addition, since the rear space is substantially closed, the water remaining in the rear space is difficult to discharge. In a stand-up type personal watercraft, typically, an upper surface of a rear portion of the deck, i.e., an upper portion of the rear space forms a standing deck, and an opening for maintenance purpose that leads to an inside of the rear space is not provided. In this construction, the water remaining within the rear space is difficult to discharge.

The above described foam structure within the rear space, is formed by continuous air-bubbles and has water-absorbing ability. The water flowing into the rear space is absorbed by the foam structure, so that the buoyant force acting on the body is reduced. Further, the water absorbed in the foam structure is difficult to remove therefrom.

SUMMARY OF THE INVENTION

The present invention addresses the above described condition, and an object of the present invention is to provide a personal watercraft capable of discharging water flowing into a closed rear space within a body and capable of inhibiting a foam structure from absorbing the water flowing into the rear space.

According to the present invention, there is provided a body structure of a water-jet propulsion personal watercraft, comprising a body having an inner space defined by a hull and a deck, an engine mounted within the inner space of the body, a water jet pump placed behind the engine and configured to be driven by the engine, and a bulkhead placed behind the engine and configured to separate the inner space of the body into an engine room on a front side within which the engine is contained, and a closed rear space on a rear side, wherein a first drain hole is provided in the closed rear space so as to communicate with an outside of the watercraft.

In such a construction, even when water flows into the closed rear space, such water can be discharged through the first drain hole. While the watercraft is on the water, the first drain hole is closed by a drain plug, and after the watercraft is beached, the water remaining in the rear space may be discharged by opening the first drain hole.

The first drain hole may be formed in a rear end portion of the hull and configured to communicate with a groove provided inside a chine extending along a longitudinal direction of the body on a bottom surface of the hull, the groove being configured to extend along the chine. Since the water tends to remain in the groove within the rear space, the water is easily discharged outside the watercraft through the first drain hole communicating with the groove.

The bulkhead may be provided with a second drain hole configured to allow the engine room and the rear space to communicate with each other. In this construction, since the first drain hole and the second hole allow the engine room to communicate with the outside of the watercraft through the rear space, the water flowing into the engine room can be easily discharged outside the watercraft through the rear space when discharging the water from the rear space.

The second drain hole may communicate with the first drain hole through a groove provided inside a chine extending along a longitudinal direction of the body on a bottom surface of the hull, the groove being configured to extend along the chine. In this construction, the water within the rear space, and the water within the engine room can be easily discharged through the first drain hole.

A foam structure for allowing a buoyant force to act on the body may be formed in advance so as to conform in shape to an interior of the rear space and may be contained within the rear space. Since the foam structure substantially conforms in shape to the interior of the rear space when formed within the rear space, the ratio of the volume of the foam structures to the rear space can be increased. Since the foam structure substantially fills the rear space, the foam structure may alternatively be referred to as a foam "filler" or "packing" structure.

A plurality of pipes including an exhaust pipe configured to discharge an exhaust gas from the engine may be arranged within the rear space, and the foam structure may be composed of a plurality of foam structures or blocks. Since each of the plurality of foam structures is of relatively small size, the foam structures can be contained relatively easily in a rear space within which pipes are intricately arranged. Also, the ratio of the volume of the foam structures to the rear space can be increased.

The plurality of foam structures may be formed so as to conform to positions where the pipes are provided and may be arranged in a vertical direction of the body so as to be located on and under the pipes. The first and second foam structures may be placed within the rear space in the following order: i) the first foam structure is first placed within the rear space, ii) the pipes are arranged on the first foam structure, and iii) the second foam structure is placed to cover the pipes from above. In this order, injection-molded foam structures are easily formed within the rear space. In addition, the ratio of the volume of the foam structures to the rear space can be increased.

The above described foam structure may be composed of closed cells. The water flowing into the rear space is not substantially absorbed into the foam structures made of the closed cells. Therefore, most of the water flowing into the rear space can be discharged through the drain hole.

The personal watercraft may be a stand-up type personal watercraft. While the rear space of the stand-up type personal watercraft is typically closed and typically is not provided with an opening for maintenance purpose, the water flowing into the inside of the rear space can be discharged effectively as described above.

The above and further objects and features of the invention will more fully be apparent from the following detailed description with accompanying drawings.

DETAILED DESCRIPTION OF THE PREFERRED EMBODIMENTS

Figure 1:
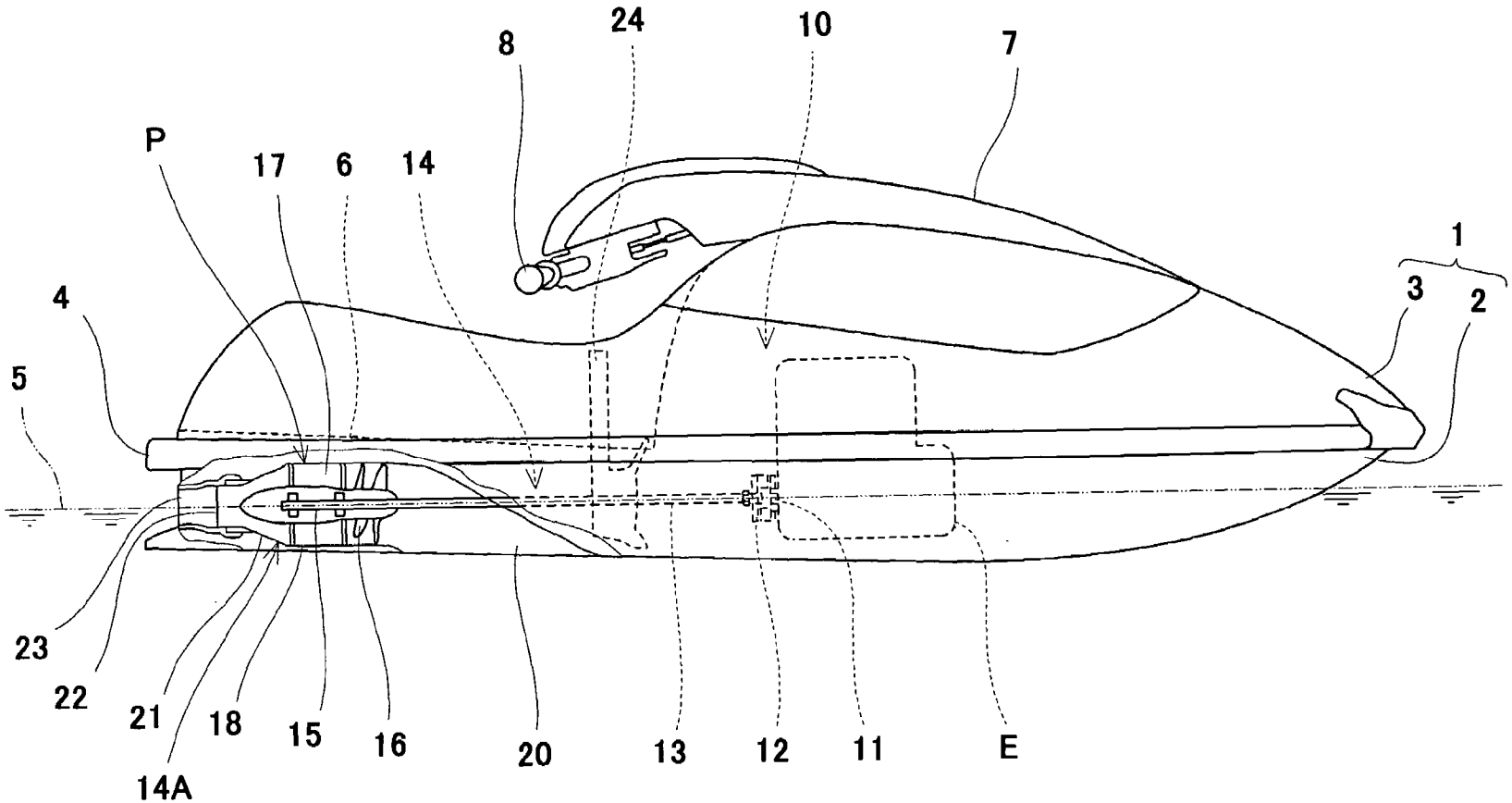
FIG. 1 is a side view of a personal watercraft according to an embodiment of the present invention.

Hereinafter, an embodiment of a body structure of a water jet propulsion personal watercraft will be described with reference to the drawings. The personal watercraft in FIG. 1 is a stand-up type personal watercraft. A body 1 of the watercraft has an inner space defined by a hull 2 and a deck 3 covering the hull 2 from above. A line at which the hull 2 and the deck 3 are connected over the entire perimeter thereof is called a gunnel line 4. The gunnel line 4 is located above a waterline 5 of the body 1 at rest on the water.

The deck 3 is provided with a flat standing deck 6 at a rear portion thereof on which a rider rides in a standing or kneeling position. A front end of a steering pole 7 is pivotally mounted on a front portion of the body 1. The steering pole 7 is configured to extend rearward from the front end, and is provided with a steering bar-type handle 8 at a rear end portion thereof.

An engine room 10 is provided in an inner space substantially at the center in the longitudinal direction of the body 1. An engine E is mounted within the engine room 10 and configured to drive the watercraft. The engine E is mounted such that a crankshaft 11 extends along the longitudinal direction of the body 1.

A rear end of the crankshaft 11 is connected to a propeller shaft 13 through a coupling means 12. The propeller shaft 13 is connected to a pump shaft 15 of a water jet pump P provided within a pump room 14A on the rear portion of the body 1. Therefore, the pump shaft 15 rotates in cooperation with rotation of crankshaft 11. An impeller 16 is attached on the pump shaft 15. Fairing vanes 17 are provided behind the impeller 16. The impeller 16 is covered with a pump casing 18 on the outer periphery thereof.

A water intake 20 is provided on the bottom of the body 1. The water intake 20 is connected to the pump casing 18 through a water passage. The pump casing 18 is connected to a pump nozzle 21 provided on the rear side of the body 1. The pump nozzle 21 has a cross-sectional area that gradually reduces rearward, and an outlet port 22 is provided on the rear end of the pump nozzle 21.

The water outside the watercraft is sucked from the water intake 20 and fed to the water jet pump P. The water jet pump P pressurizes and accelerates the water and the fairing vanes 17 guide water flow behind the impeller 16. The water is ejected through the pump nozzle 21 and from the outlet port 22 and, as the resulting reaction, the watercraft obtains a propulsion force.

A tubular steering nozzle 23 is provided behind the pump nozzle 21. The steering nozzle 23 is connected to the bar-type steering handle 8 through a cable (not shown). When the rider rotates the handle 8 clockwise or counter-clockwise, the steering nozzle 23 is swung toward the opposite direction so that the ejection direction of the water being ejected through the pump nozzle 21 can be changed, and the watercraft can be correspondingly turned to any desired direction while the water jet pump P is generating the propulsion force.

A bulkhead 24 is provided within the inner space of the body 1 and behind the engine E so as to traverse the inner space. The bulkhead 24 separates the inner space of the body 1 into the engine room 10 and a rear space 14 that contains a foam structure 50 (see FIG. 2) for allowing a buoyant force to act on the body as described later. The rear space 14 is a closed space surrounded the hull 2, the deck 3, and the bulkhead 24. The propeller shaft 13 is configured to extend through the bulkhead 24 between the engine E and the water jet pump P. And, within the rear space 14, various pipes are provided as described later.

Figure 2:
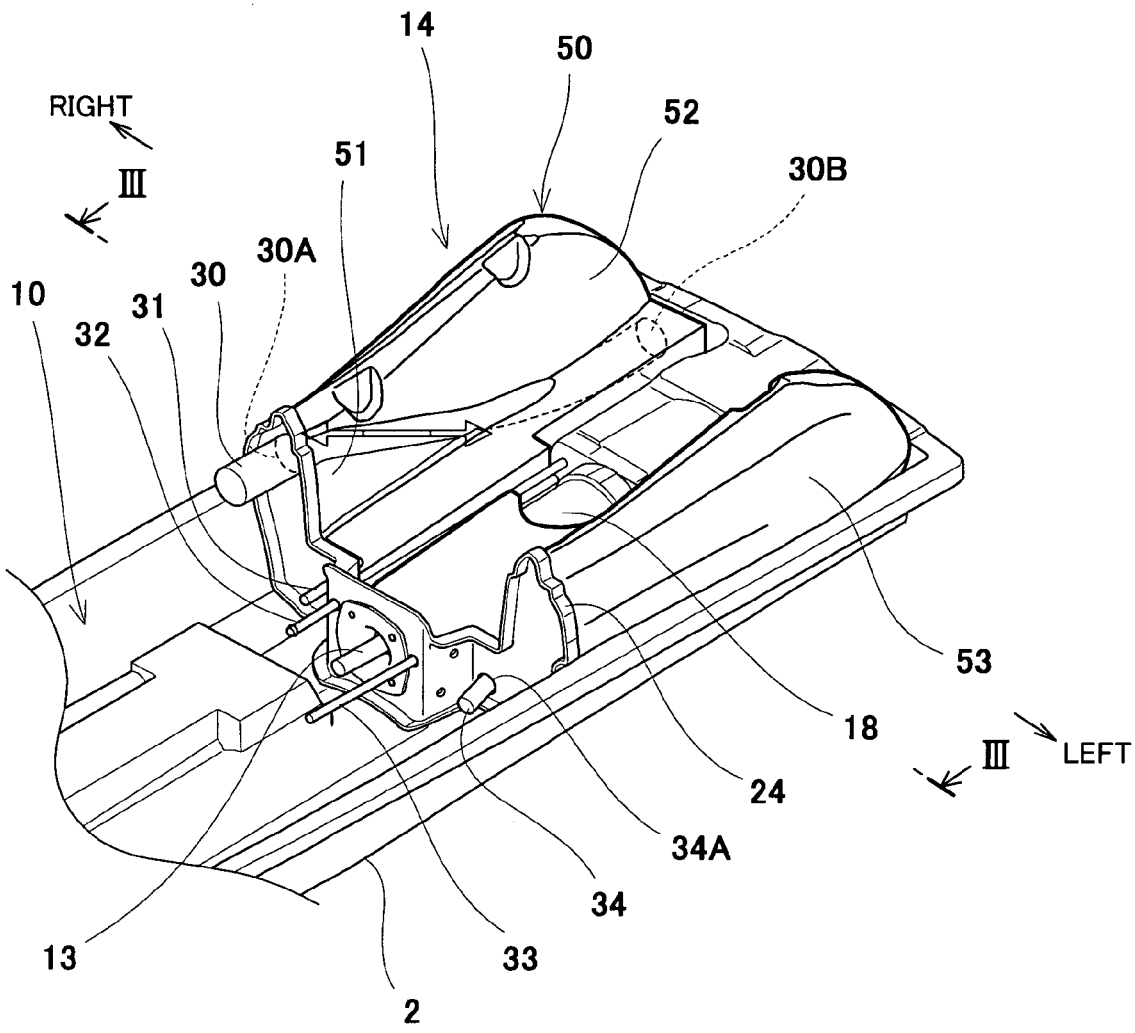
FIG. 2 is a partial perspective view of the personal watercraft in FIG. 1, showing a structure within a rear space in which pipes and foam structures are provided, with a deck removed away.

As shown in FIG. 2, within the rear space 14, various pipes are arranged; for example, an exhaust pipe 30 configured to draw an exhaust gas being discharged from the engine E (see FIG. 1) and then flowing within a muffler, a bilge pipe 31 configured to forcibly discharge water from an inside of the engine room 10 by a pump (not shown) or a negative pressure of the water jet pump P during running, a cooling water drawing pipe 32 configured to draw the water from an inside of the water jet pump P and supply the water to the engine E and auxiliary equipment for use as cooling water, a cooling water discharge pipe 33 configured to discharge the cooling water that has finished cooling outside the watercraft, and a steering cable pipe 34 into which a cable connecting the steering bar-type handle 8 to the steering nozzle 23 in FIG. 1 is inserted.

As shown in FIG. 2, the exhaust pipe 30 is provided on the right side within the body 1. The exhaust pipe 30 is configured to extend from a penetrating hole 30A provided in the bulkhead 24 to a penetrating hole 30B provided in the hull 2 on the right side of the rear end portion of the body 1. And, the bulkhead 24 is provided with penetrating holes 31A to 33A (see FIG. 3) through which the bilge pipe 31, the cooling water drawing pipe 32, and the cooling water discharge pipe 33 are inserted, respectively. The pipes 31 to 33 are configured to extend in the rear space 14 from the penetrating holes 31A to 33A to the pump casing 18 (see FIG. 1) contained within the pump room 14A formed on a bottom surface of the hull 2.

As shown in FIG. 2, the bulkhead 24 is further provided with a penetrating hole 34A through which a steering cable pipe 34 is inserted. The steering cable pipe 34 is provided between the penetrating hole 34A and the steering nozzle 23 (see FIG. 1).

Figure 3:
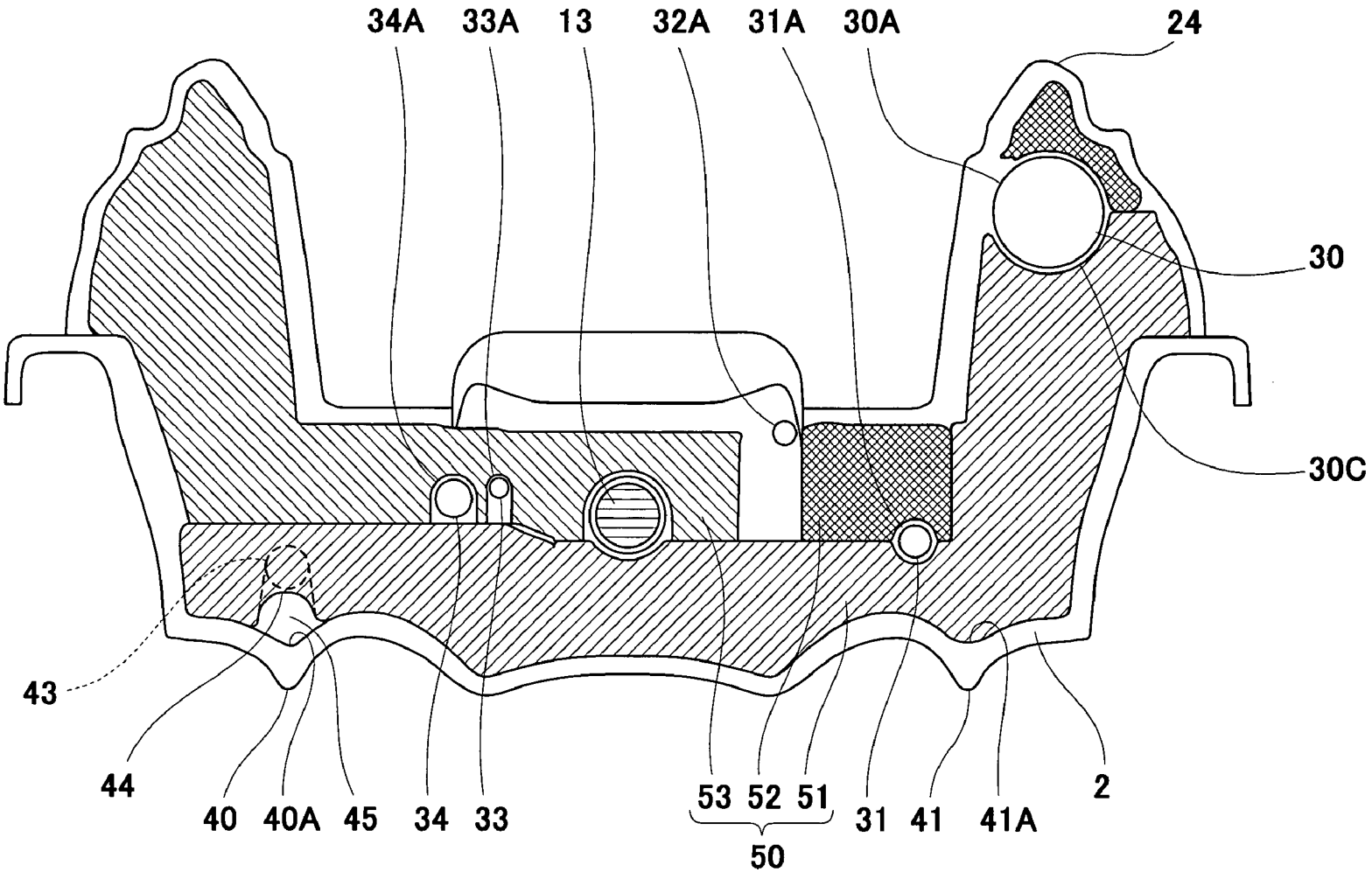
FIG. 3 is a cross-sectional view taken along line III—III in FIG. 2, showing the structure within the rear space including a drain mechanism, with the deck removed away.

As shown in FIGS. 2 and 3, within the rear space 14, the foam structure 50 is contained. The foam structure 50 is composed of closed cells and made of a plastic material having flexibility, such as polyethylene, polypropylene, or the like. The foam structure 50 has a shape formed by injection-molding or the like so as to conform in shape to an interior of the rear space 14, i.e., a shape of the space defined by the hull 2, the deck 3, and the bulkhead 24, and arrangement of the pipes 30 to 34. The foam structure 50 is composed of three parts, or blocks, according to the arrangement of the pipes 30 to 34. Specifically, the foam structure 50 is composed of a first foam structure 51 provided in a bottom portion of the rear space 14, a second foam structure 52 provided on the first foam structure 51 to be located on the right side, and a third foam structure 53 provided on the first foam structure 51 to be located on the left side. The first foam structure 51, the second foam structure 52, and the third foam structure 53 are formed by closed cells.

Figure 4:
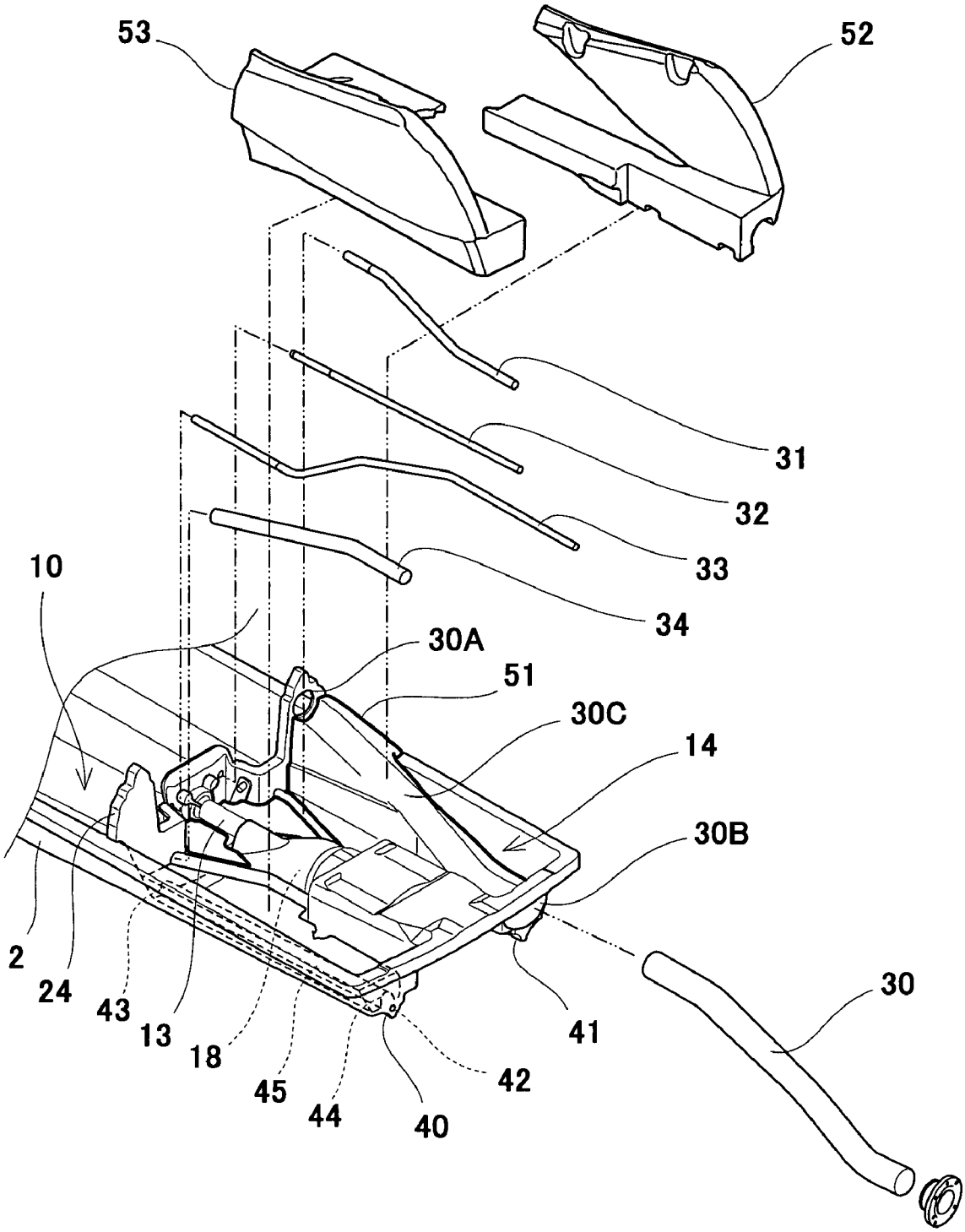
FIG. 4 is an exploded perspective view of a rear portion of the body with the deck removed away, showing pipes and the foam structures contained within the rear space.

As shown in FIGS. 3 and 4, the first foam structure 51 extends over a region below the propeller shaft 13 within the rear space 14 and over a right-side region within the rear space 14.

A groove 30C is formed on an upper portion of a right-side portion of the first foam structure 51. The groove 30C is recessed to be curved downwardly so as to conform in shape to a lower portion of the exhaust pipe 30 extending from the penetrating holes 30A to the penetrating hole 30B. The exhaust pipe 30 extends along the groove 30C. In addition, for the bilge pipe 31, the cooling water drawing pipe 32, the cooling water discharge pipe 33, and the steering cable pipe 34, grooves are formed on the first foam structure 51 so as to conform in shape to the pipes 31 to 34.

As shown in FIG. 3, chine portions 40 and 41 are respectively provided on right and left sides of the bottom portion of the hull 2 to protrude downwardly along the longitudinal direction of the watercraft. On an inner bottom portion of the hull 2, grooves 40A and 40B are respectively formed to be curved downwardly so as to conform in shape to the chine portions 40 and 41 and configured to extend along the chine portions 40 and 41. As shown in FIG. 4, a first drain hole 42 is formed in a rear end portion (rear end wall) of the hull 2 which is located at a rear end of the chine portion 40 in communication with the groove 40A to thereby allow the rear space 14 to communicate with the outside of the watercraft. As shown in FIGS. 3 and 4, a second drain hole 43 is formed in the bulkhead 24 at a position above the chine portion 40 on the left side to allow the engine room 10 and the rear space 14 to communicate with each other.

Further, as shown in FIG. 3, a groove 44 is formed on a left-side lower portion of the first foam structure 51 along the groove 40A of the chine portion 40. The groove 44 is upwardly curved. A passage formed by the groove 40A of the chine portion 40 and the groove 44 of the first foam structure 51 form a drain passage 45. The rear space 14 communicates with the outside of the watercraft through the first drain hole 42 and the drain passage 45. The engine room 10 communicates with outside the watercraft through the first and second drain holes 42 and 43 and the drain passage 45.

As shown in FIGS. 2 to 4, the second foam structure 52 is placed on the first foam structure 51 on the right side within the rear space 14 so as to cover the exhaust pipe 30 and the bilge pipe 31 from above. With the second foam structure 52 placed on the first foam structure 51, portions of the second foam structure, which correspond to the exhaust pipe 30 and the bilge pipe 31, are recessed so as to conform in shape to the exhaust pipe 30 and the bilge pipe 31. The first foam structure 51 and the second foam structure 52 allow the exhaust pipe 30 and the bilge pipe 31 to be stably supported.

As shown in FIGS. 2 to 4, the third foam structure 53 is provided on the first foam structure 51 to extend over an upper region of the pump casing 18 and over a left-side region of the rear space 14, and covers the propeller shaft 13, the cooling water discharge pipe 33, and the steering cable pipe 34 from above. With the third foam structure 53 placed on the first foam structure 51, portions of the third foam structure 53, which correspond to the propeller shaft 13, the cooling water discharge pipe 33, and the steering cable pipe 34, are recessed so as to conform in shape to these members. The first foam structure 51 and the third foam structure 53 allow the cooling water discharge pipe 33 and the steering cable pipe 34 to be stably supported.

As shown in FIG. 4, the first foam structure 51, the second foam structure 52, the third foam structure 53, and the pipes 30 to 34 are arranged within the rear space 14 in the following order. First, the first foam structure 51 is placed in the bottom portion within the rear space 14. Then, the exhaust pipe 30, the bilge pipe 31, the cooling water drawing pipe 32, the cooling water discharge pipe 33, and the steering cable pipe 34 are arranged on the first foam structure 51. Further, the second foam structure 52 and the third foam structure 53 are placed on the first foam structure 51 so as to cover the pipes 30 to 34 from above.

In the case of the personal watercraft constructed as described above, the first drain hole 42 is provided to allow the rear space 14 to communicate with the outside of the watercraft. Even when water flows into the rear space 14, such water is discharged through the first drain hole 42. The first drain hole 42 is closed by a drain plug and, when the watercraft is beached, the drain plug is removed, thereby allowing the water to be discharged.

In addition, since the second drain hole 43 is provided so as to allow the rear space 14 and the engine room 10 to communicate with each other, the engine room 10 communicates with the outside of the watercraft through the drain passage 45 within the rear space 14. This construction makes it possible to discharge the water remaining in the engine room 10 when discharging the water within the rear space 14.

Further, since the foam structure 50 (first foam structure 51, second foam structure 52, and third foam structure 53) provided within the rear space 14 is molded to conform in shape to the internal structure of the rear space 14 and is composed of the closed cells, the foam structure 50 is inhibited from absorbing the water flowing into the rear space 14. Since the foam structure 50 is composed of the first foam structure 51 on the lower side, and the second foam structure 52 and the third foam structure 53 on the upper side, which are configured according to arrangement of the pipes 30 to 34, the foam structure 50 is easily placed within the rear space 14 regardless of the presence of the pipes 30 to 34. Also, the ratio of the volume of the foam structure 50 to the rear space 14 is increased.

Instead of the three parts, the foam structure 50 may be composed of two or four or more parts depending on piping configuration. Also, depending on the construction of the body, the present invention is also applicable to a straddle-type personal watercraft provided with a seat straddled by a rider, as well as to the above described stand-up type personal watercraft.

Figure 5:
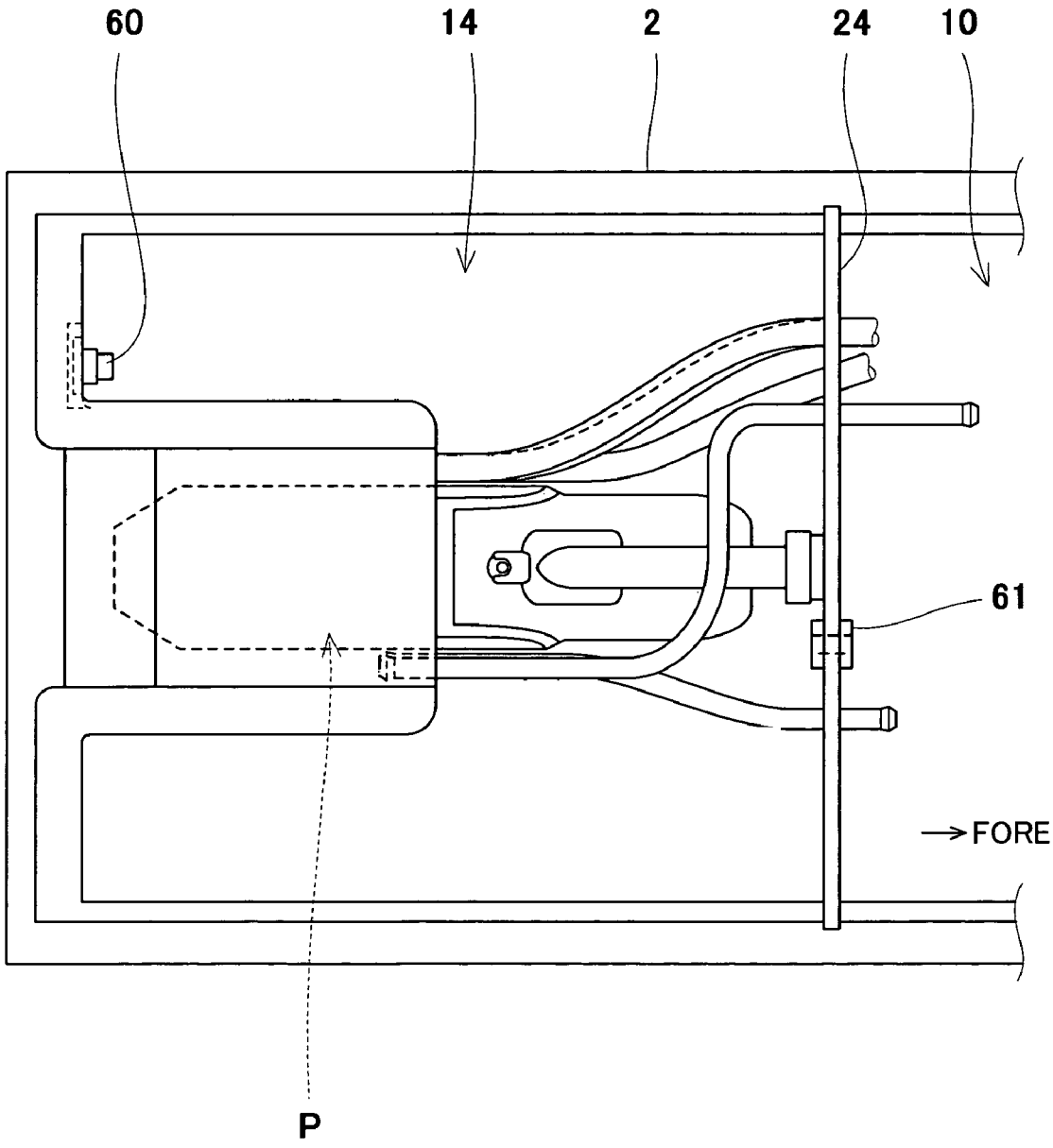
FIG. 5 is an enlarged plan view of the rear portion of the body, showing another construction of the drain mechanism.
Figure 6:
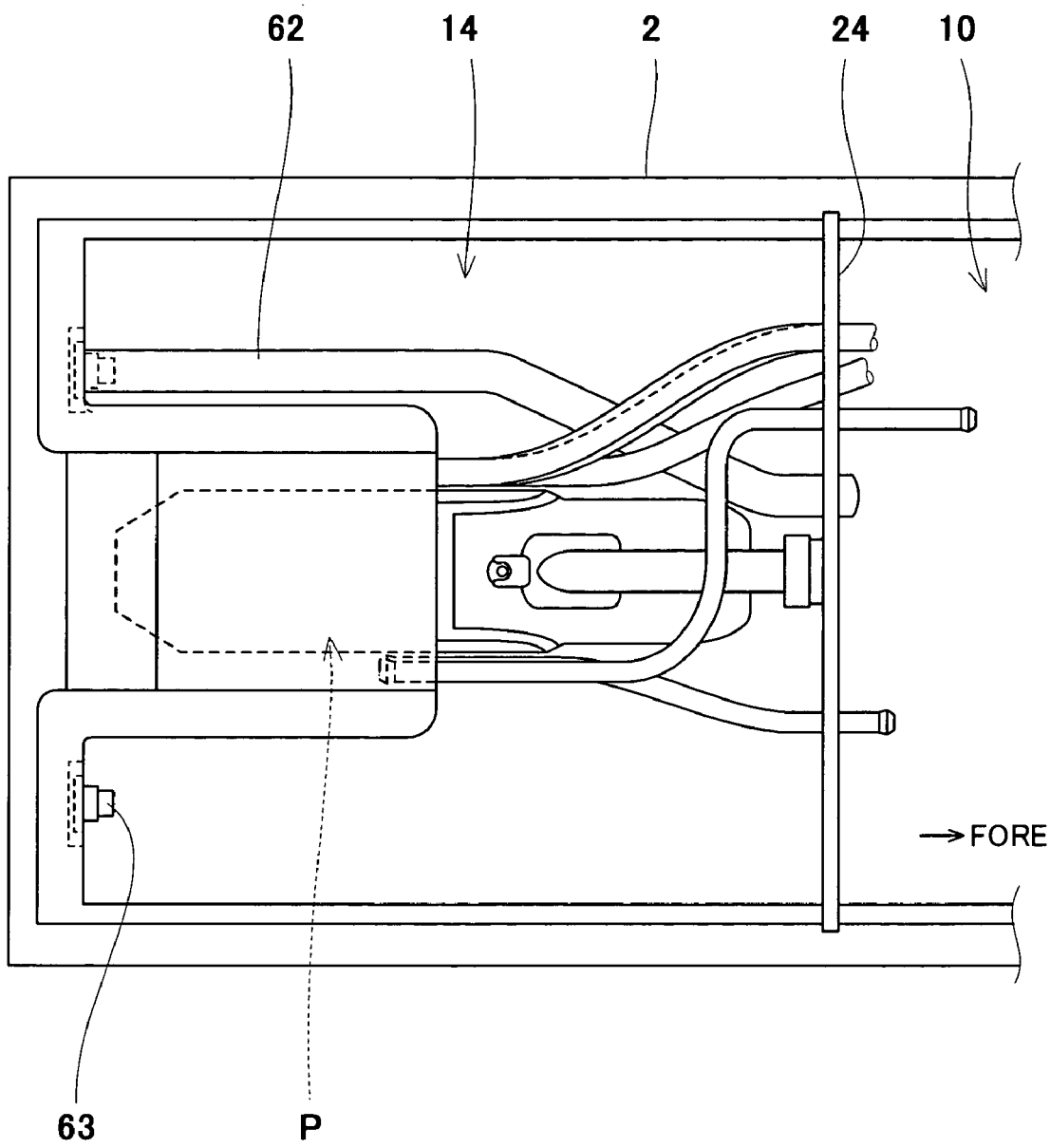
FIG. 6 is an enlarged plan view of the rear portion of the body, showing another construction of the drain mechanism.

A drain mechanism configured to discharge the water is not limited to those in FIGS. 2 to 4. FIGS. 5 and 6 show other constructions of the drain mechanism. In the construction in FIG. 5, a first drain hole 60 is provided on the left side of the rear end wall of the hull 2 to allow the rear space 14 to communicate with the outside of the watercraft, and a second drain hole 61 is provided at a position of the bulkhead 24 which is slightly rightward with respect to its center.

As described above, the first drain hole 60 configured to allow the rear space 14 to communicate with outside of the watercraft and the second drain hole 61 configured to allow the engine room 10 to communicate with the rear space 14 may be located at any suitable locations. It should be appreciated that the first and second drain holes 60 and 61 are located to be as close to the bottom of the watercraft as possible.

In construction of the drain mechanism in FIG. 6, a drain pipe 62 is provided to extend through the rear space 14 in the longitudinal direction to thereby allow the engine room 10 to communicate with the outside the watercraft, and a drain hole 63 is provided to allow the rear space 14 to communicate with the outside of the watercraft. In this construction, only the water within the rear space 14 can be discharged through the drain hole 63. It is desirable to locate the drain hole 63 to be as close to the bottom of the watercraft as possible.

In the constructions of the drain mechanisms in FIGS. 5 and 6, the plurality of the foam structures shown in FIGS. 2 to 4 may be contained within the rear space 14.

As this invention may be embodied in several forms without departing from the spirit of essential characteristics thereof, the above embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A body structure of a water-jet propulsion personal watercraft, comprising:

a body having an inner space defined by a hull and a deck;

an engine mounted within the inner space of the body;

a water jet pump placed behind the engine and configured to be driven by the engine; and a bulkhead placed behind the engine and configured to separate the inner space of the body into an engine room on a front side within which the engine is contained, and a closed rear space on a rear side which surrounds the water jet pump from above and laterally;

wherein a first drain hole is provided in the closed rear space of the body so as to communicate with an outside of the watercraft to cause water to be discharged from within the closed rear space to the outside; and wherein the first drain hole is formed in a rear end portion of the hull and configured to communicate with a groove formed in an inner bottom surface of the hull and inside of a chine extending along a longitudinal direction of the body on a bottom surface of the hull, the groove being configured to extend along the chine and to open into the closed rear space.

2. The body structure of a water-jet propulsion personal watercraft, according to claim 1, wherein the bulkhead is provided with a second drain hole configured to allow the engine room and the closed rear space to conimunicate with each other to cause the water to flow from the engine room to the closed rear space.

3. The body structure of a water-jet propulsion personal watercraft, according to claim 2, wherein the second drain hole communicates with the first drain hole through the groove formed in the inner bottom surface of the hull.

4. The body structure of a water-jet propulsion personal watereraft, according to claim 3, further comprising:

a foam structure contained within the closed rear space for allowing a buoyant force to act on the body, the foam structure being composed of a plurality of foam blocks and being formed to have a predetermined shape, independently of the body to conform in shape to an interior of the rear space.

5. The body structure of a water-jet propulsion personal watereraft, according to claim 4, wherein an exhaust pipe configured to discharge an exhaust gas from the engine extends through an interior of the foam structure within the closed rear space.

6. The body structure of a water-jet propulsion personal watercraft, according to claim 5, wherein the plurality of foam blocks are formed so as to conform to positions where the exhaust pipe is provided and are arranged in a vertical direction of the body so as to be located on and under the exhaust pipe.

7. The body structure of a water-jet propulsion personal watercraft, according to claim 4, wherein the foam structure is formed by closed cells.

8. A body structure of a water-jet propulsion personal watereraft, comprising:

a body having an inner space defined by a hull and a deck;

an engine mounted within the inner space of the body;

a water jet pump placed behind the engine and configured to be driven by the engine; and a bulkhead placed behind the engine and configured to separate the inner space of the body into an engine room on a front side within which the engine is contained, and a closed rear space on a rear side;

wherein a first drain hole is provided in the closed rear space of the body so as to communicate with an outside of the watercraft to cause water to be discharged from within the closed rear space to the outside;

wherein the first drain hole is formed in a transversely extending rear end wall of the hull and is configured to communicate with a groove formed in an inner bottom surface of the hull; and wherein the personal watercraft is a stand-up type personal watereraft including, above the water jet pump, a foot deck on which an operator rides.

9. The body structure of a water-jet propulsion personal watercraft, according to claim 8, wherein the groove is formed inside of a chine extending along a longitudinal direction of the body on a bottom surface of the hull, the groove being configured to extend along the chine and to open into the closed rear space.

10. The body structure of a water-jet propulsion personal watereraft, according to claim 8, wherein the bulkhead is provided with a second drain hole configured to allow the engine room and the closed rear space to communicate with each other to cause water to flow from the engine room to the closed rear space.

11. The body structure of a water-jet propulsion personal watercraft, according to claim 10, wherein the second drain hole communicates with the first drain hole through the groove formed in the inner bottom surface of the hull.

12. The body structure of a water-jet propulsion personal watereraft, according to claim 8, wherein a foam structure for allowing a buoyant force to act on the body is formed in advance to conform in shape to an interior of the closed rear space and is contained within the rear space, the closed rear space being positioned at a rear region of the deck and between a lower surface of the foot deck and the inner bottom surface of the hull.

13. The body structure of a water-jet propulsion personal watereraft, according to claim 12, wherein a plurality of pipes including an exhaust pipe configured to discharge an exhaust gas from the engine are arranged within the rear space, and the foam structure is composed of a plurality of foam blocks.

14. The body structure of a water-jet propulsion personal watercraft, according to claim 13, wherein the plurality of foam blocks are formed so as to conform to positions where the pipes are provided and are arranged in a vertical direction of the body so as to be located on and under the pipes.

15. The body structure of a water-jet propulsion personal watercraft, according to claim 12, wherein the foam structure is formed by closed cells.

16. A body structure of a water-jet propulsion personal watercraft, comprising:

a body having an inner space defined by a hull and a deck;

an engine mounted within the inner space of the body;

a water jet pump placed behind the engine and configured to be driven by the engine;

a bulkhead placed behind the engine and configured to separate the inner space of the body into an engine room on a front side within which the engine is contained, and a closed rear space on a rear side; and a foam structure contained within the rear space for allowing a buoyant force to act on the body, the foam structure being composed of a plurality of foam blocks and being preformed to have a predetermined shape independently of the body to conform in shape to an interior of the rear space;

wherein a first drain hole is provided in the closed rear space of the body so as to communicate with an outside of the watercraft;

wherein a plurality of pipes including an exhaust pipe configured to discharge an exhaust gas from the engine are arranged within the rear space; and wherein the plurality of foam blocks are positioned within the rear space so as to conform to positions where the pipes are provided the plurality of foam blocks being stacked vertically so as to be disposed above and below the pipes and are arranged in a vertical direction of the body so as to be located on and under the pipes.

* * * * *